United States Patent [19]

Eustice et al.

[11] Patent Number: 4,858,921

[45] Date of Patent: Aug. 22, 1989

[54] BALL SUSPENDING APPARATUS AND METHOD

[76] Inventors: Harold L. Eustice, 8422 E. Desert Steppes, Tucson, Ariz. 85710; William T. Foster, 4576 E. Fifth St., Tucson, Ariz. 85711

[21] Appl. No.: 230,728

[22] Filed: Aug. 5, 1988

Related U.S. Application Data

[63] Continuation-in-part of Ser. No. 77,396, Jul. 24, 1984, abandoned.

[51] Int. Cl.[4] ..... A63B 69/40

[52] U.S. Cl. ..... 273/26 R; 446/179; 124/56

[58] Field of Search ..... 273/1 R, 201, 26 R; 124/62, 56, 71; 446/179; 40/412, 439, 409

[56] References Cited

U.S. PATENT DOCUMENTS

| | | | |
|---|---|---|---|
| 2,055,498 | 9/1936 | Jacobs | 40/409 |
| 2,074,363 | 3/1937 | Burke | 446/179 |
| 2,100,690 | 11/1937 | Andler | 40/409 |
| 2,903,817 | 9/1959 | McLain et al. | 446/179 |
| 2,924,459 | 2/1960 | Bryant | 446/179 |
| 2,991,745 | 11/1959 | Simon | 446/179 |
| 3,083,497 | 4/1963 | Novak et al. | 446/179 |
| 3,774,584 | 11/1973 | Paulson | 273/26 D |
| 3,887,182 | 6/1975 | Breslow | 446/179 |
| 4,045,906 | 9/1977 | Goldfarb et al. | 273/359 |
| 4,211,412 | 7/1980 | Breslow et al. | 446/179 |
| 4,564,195 | 1/1986 | McClure et al. | 273/29 A |
| 4,575,080 | 3/1986 | Miles | 273/29 A |

*Primary Examiner*—Edward M. Coven
*Assistant Examiner*—T. Brown
*Attorney, Agent, or Firm*—Harry M. Weiss

[57] ABSTRACT

Disclosed is an improved ball suspending apparatus which utilizes a dual directional component air stream to support the ball for striking. The dual directional component air stream allows the ball to be spun according to the desire of the operator. For example, a baseball may be supported to simulate the certain spins associated with fastball or curveball pitches thrown by either left or right handed pitchers, thereby allowing the batter to experience the manner in which a certain type of pitch will react when struck with a bat.

34 Claims, 2 Drawing Sheets

BALL SUSPENDING APPARATUS AND METHOD

This is a continuation-in-part of co-pending application Ser. No. 077,396, filed on July 24, 1987, now abandoned.

BACKGROUND OF THE INVENTION

1. Field of the Invention

The present invention generally relates to an improved ball suspending apparatus and, more specifically, to an improved ball suspending apparatus which utilizes a stream of forced air to both suspend and selectively spin a playing ball to accommodate practicing, for example a baseball swing.

2. Description of the Prior Art

In the past, the devices were developed to support a variety of sport balls for hitting or stroking practice were subject to a major limitation—an inability to impart desired spinning action on a ball which is held stationary by a stream of air.

The prior art reveals numerous references. For example, Osaka et al. (U.S. Pat. No. 4,517,953) teach a ball throwing machine for hitting out tennis balls or the like which incorporates a hitting lever that strikes the balls to propel them in a desired direction. Kahelin (U.S. Pat. No. 4,423,717) reveals a double wheel ball propelling machine that utilizes two spinning wheels to throw a ball placed therebetween. Akin to Osaka et al. and Kahelin (4,432,717), Kahelin (U.S Pat. No. 3,838,676) also discloses a ball throwing machine which does not support a ball in a stationary position. Kahelin (3,838,676) reveals a compressed fluid ball projecting apparatus including several barrel-type extensions for varying the speed of the ball. McClure et al. (U.S. Pat. No. 4,564,195) teach a tennis ball support device which incorporates a single directional component stream of forced air to hold the tennis ball in "mid-air". Miles (U.S. Pat. No. 4,575,080) discloses an air suspension batting tee that supports a ball directly above a conduit through which the air is forced. Miles teaches a vertically oriented conduit which may move in a circular fashion around a vertical axis thereby moving the supported ball in a similar manner; Miles also discloses an optional vertical oscillation of the supported ball. Cardieri (U.S. Pat. No. 4,445,685) reveals a batting tee consisting primarily of a vertical member upon which a ball is placed to be hit.

None of these references, however, disclose a ball suspending apparatus with a dual directional component air stream which imparts spin on the ball to simulate different pitches. None of the above references disclose a ball suspending apparatus with sufficient power to suspend the ball in mid air and overcome the weight of a baseball or softball. The above references also do not teach a ball suspending apparatus which can withstand the impact of a swinging bat accidentally striking the ball suspending apparatus without damaging the ball suspending apparatus.

Therefore, there is a distinct need for an improved ball suspending apparatus as disclosed and described herein.

SUMMARY OF THE INVENTION

It is an object of this invention to provide an improved ball suspending apparatus.

It is a further object of this invention to provide an improved ball suspending apparatus capable of imparting different spinning action on the ball.

It is another object of this invention to provide an improved ball suspending apparatus which supports the ball without contacting it.

It is a still further object of this invention to provide an improved ball suspending apparatus that utilizes a stream of air consisting of both horizontal and vertical directional components.

It is a further object of this invention to provide an improved ball suspending apparatus with adequate power to both suspend and spin the weight of a baseball or softball.

It is another object of this invention to provide an improved ball suspending apparatus having a flexible air passage assembly which can withstand the impact of a swinging bat without resulting damage.

It is still another object of this invention to provide an improved ball suspending apparatus having an air passage assembly which can be bent to a desired angle.

It is yet another object of this invention to provide an improved ball suspending apparatus which duplicates the spins of different types of pitches, such as a fastball or a curveball.

The aforementioned and other objects are accomplished according to the present invention through the use of a stream of forced air which has both horizontal and vertical directional components for supporting as well as spinning a playing ball such as a baseball.

The foregoing and other objects, features and advantages of this invention will be apparent from the following, more particular, description of the preferred embodiments of this invention, as illustrated in the accompanying drawings.

DESCRIPTION OF THE PREFERRED EMBODIMENTS

Figure 1:
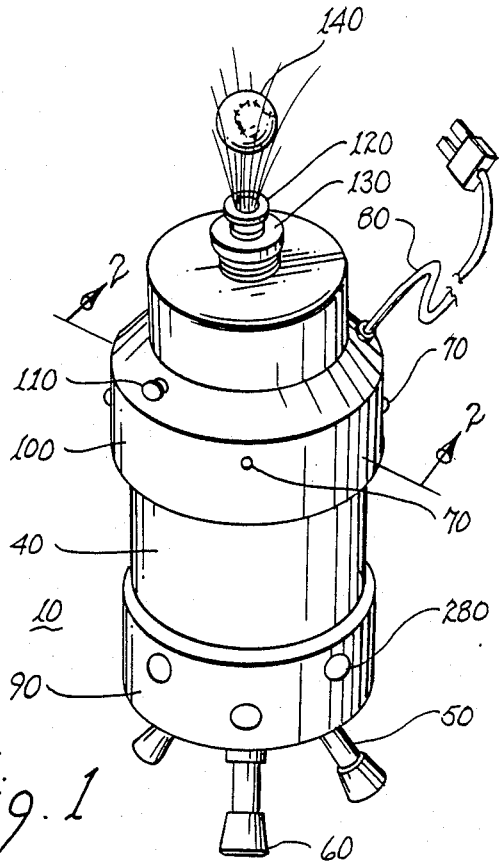
FIG. 1 is a perspective view of the subject invention without an air passage member attached.

Referring to FIG. 1 of the accompanying drawings which set forth the present invention in greater detail, and in which like numerals designate like elements, an improved ball suspending apparatus 10 is illustrated comprising a primary housing member 40, leg members 50, leg caps 60, nut and bolt assemblies 70, a power cord 80, a lower housing member 90, an upper housing member 100, a power switch 110, an upper reducer member 120, and a lower reducer member 130.

The ball suspending apparatus 10 utilizes a stream of forced air to support a sport ball 140, and is electrically powered by conventional household current which is transferred through the power cord 80. The power switch (two-pole throw or variable output) 110 controls the blower motor 180 (See FIG. 2) which creates the stream of forced air by which the ball 140 is suspended away from the apparatus. The blower motor 180 is preferably a 120 volt, 60/50 Hertz thru-flow design vacuum motor, which is capable of producing an air flow of 124 cubic feet per minute and having 93 inches of water static pressure. This motor size has been found to be sufficient to suspend and spin the weight of either a baseball or softball. Such a vacuum motor can, for example, be purchased from W. W. Grainger, Inc. and is identified as the AMETEK vacuum motor manufacturer model number 115923.

The primary housing member 40, the upper housing member 100, and the lower housing member 90 are coupled together to form an airtight seal therebetween with the only openings therein being air intake ports 280 and a central portion of the upper reducer member 120.

Figure 2:
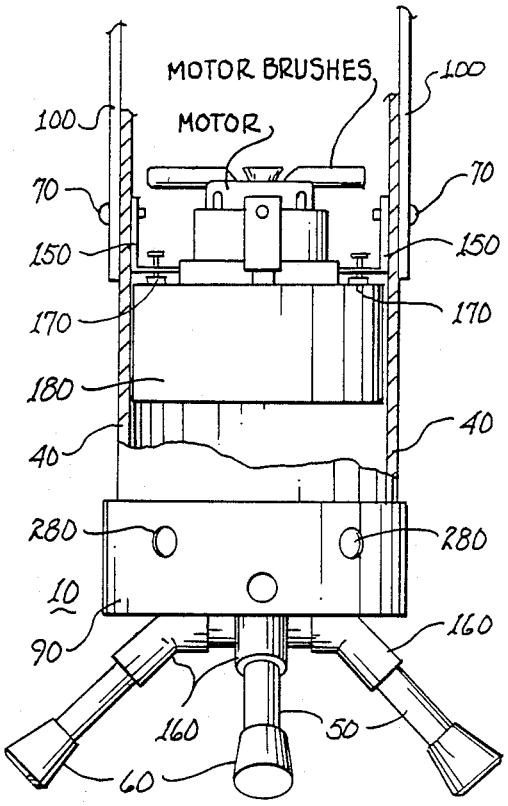
FIG. 2 is a partially cutaway front view of the present invention taken along the line 2—2 of FIG. 1.

As best illustrated in FIG. 2, air is drawn into the suspending apparatus 10 through the intake ports 280 located in the lower housing member 90 and then upward through the primary housing member 40 before a fan 190 forces the air to exit the apparatus 10 in an upward direction through the reducer members 120 and 130 (See FIG. 1).

A series of nut and bolt assemblies 70 are utilized to couple vertical portions of a corresponding series of bracket members 150 to the housing members 40 and 100. Horizontal portions of the bracket members 150 are coupled to the blower motor 180 by a series of coupling assemblies 170. In this manner the blower motor 180 and the fan 190, which together form an assembly, are firmly held within the housing members 40, 90, and 100.

The improved ball suspending apparatus 10 is supported by at least three detachable leg members 50. The leg members 50 are frictionally coupled to leg receiving sleeve members 160 which are attached to the lower housing member 90 and which have an inner diameter that is slightly larger than the outer diameter of the leg members 50 to allow for easy attachment and detachment of the leg members 50. Both the leg members 50 and the leg receiving sleeve members 160 may be constructed of plastic tubing such as PVC pipe for relatively lightweight structural strength. Leg caps 60, possibly constructed of a resilient rubber-like material, are frictionally fitted over the lower end portion of the leg members 50 both to provide protection for the surface upon which the apparatus 10 is supported and to minimize the noise and vibration levels resulting from operation of the subject ball suspending apparatus 10.

Figure 3:
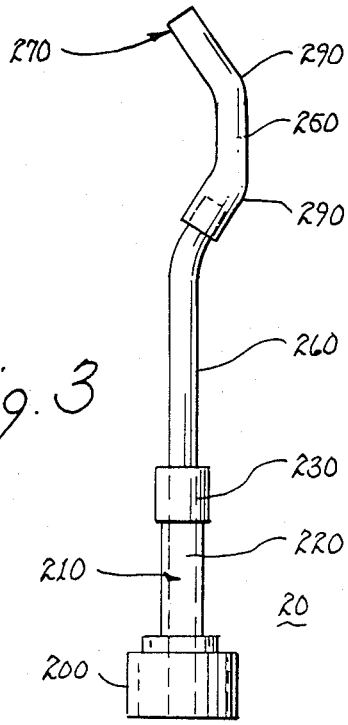
FIG. 3 is a front view of an air passage assembly suited to duplicate the spin of a pitched fastball.

Referring now to FIG. 3, a fastball simulating assembly 20 is illustrated and may also be constructed of plastic tubing. A continuous air flow duct 210 extends from a coupling ring member 200, through a lower tubular member 220, a coupling sleeve 230, an intermediate tubular member 260 and an upper tubular member 250, to an exit port 270. The coupling ring member 200 is threaded on the inner surface thereof to cooperatively and detachably engage the reducer members 120 and 130 (See FIG. 1) which are threaded on the outer surfaces thereof; and the upper tubular member 250 may be constructed of a resilient rubber-like material to allow it to be hit without sustaining damage. It should be noted that the air passage 210 of the fastball simulating assembly extends in a vertical line from the ring coupling member 200 to the upper tubular member 250 which includes two bends 290 in the same planar direction. The stream of forced air passing through the fastball simulating assembly 20 contains both a horizontal and a vertical directional component.

Figure 4:
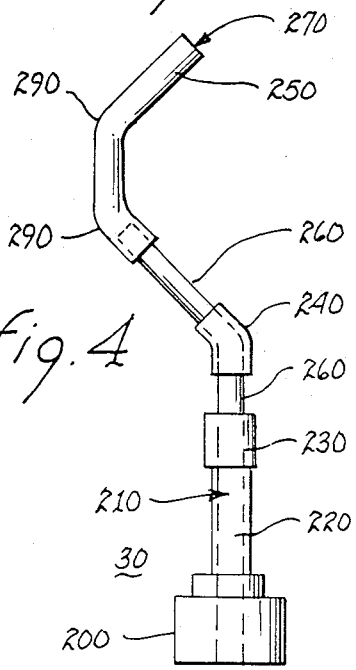
FIG. 4 is a front view of an air passage assembly suited to duplicate the spin of a pitched curveball.

A curveball simulating assembly 30 is depicted in FIG. 4 and is constructed similarly to the fastball simulating assembly 20 (See FIG. 3). However, unlike the fastball simulating assembly 20, the curveball simulating assembly 30 includes two shorter intermediate tubular members 260 which are joined by a 45° coupling elbow 240; therefore, the air flow duct 210 of the curveball simulating assembly 30 extends vertically from the coupling member 200 but is situated 45° from vertical when it enters the upper tubular member 250.

Figure 5:
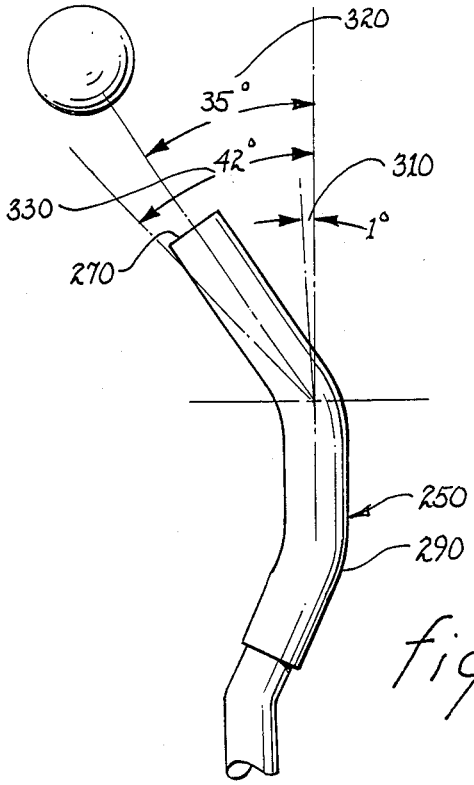
FIG. 5 is a side elevational view of the air passage assembly with the air output portion of the upper tubular member extended at an optimal 35 degree angle from a vertical axis line of the upper tubular member, and also showing the 1 to 42 degree ball suspension angle range which the upper tubular member may be angled from the vertical.

As best seen in FIG. 5, the upper portion of upper tubular member 250, which is made of resilient flexible hose material, may be moved to provide any desired angle of the available variety of angles from the vertical. The ball suspending apparatus 10 is capable of suspending and spinning either a baseball or softball in the range of from about a one degree angle depicted by line 310 to about a 42 degree angle depicted by line 330 from the vertical. The optimum angle for spinning either a baseball or a softball is about a 35 degree angle depicted by line 320 from the vertical. The desired angle of the upper air outlet portion of the upper tubular member 250 from the vertical will vary according to the size and weight of the sport ball used and the desires of the user of the equipment. The range of angles described herein are equally applicable to FIG. 3 for the simulation of a fastball, and to FIG. 4 for the simulation of a curveball.

Figure 6B:
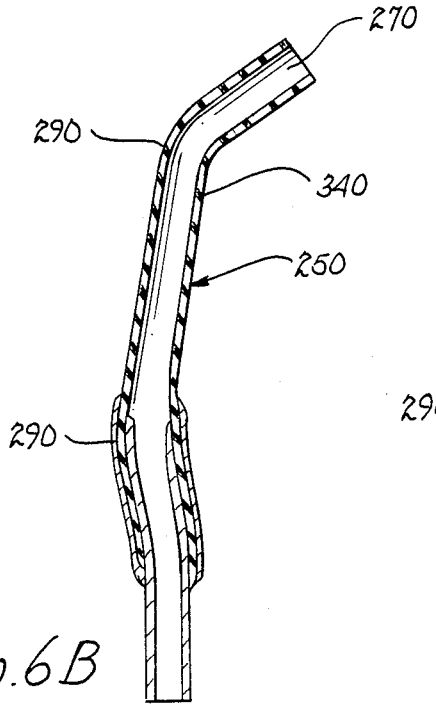
FIG. 6B is a sectional view of FIG. 6A to depict the assembly of the resilient, flexible hose materials.
Figure 6A:
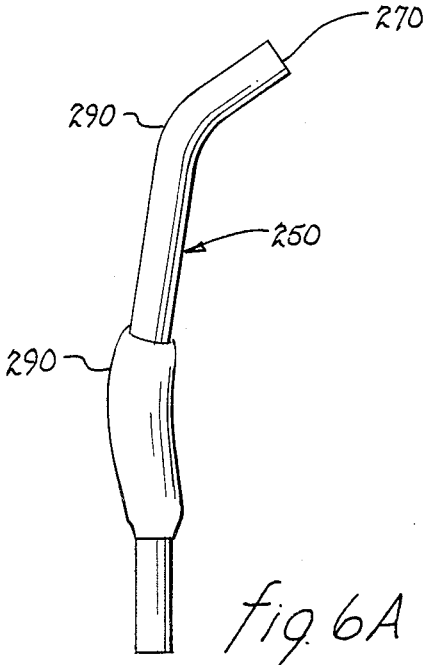
FIG. 6A is a side elevational view of the air passage assembly constructed of a resilient, flexible hose material a portion of which is located within a sleeve of resilient, flexible hose material.

As seen in FIGS. 6A and 6B, the upper tubular member 250 is preferably constructed out of a resilient, flexible hose material 340. If the upper tubular member 250 is struck by a swinging bat, the upper tubular member 250 will not break and will spring back into shape. This resilient feature of the upper tubular member 250 eliminates the need and expense of replacing the upper tubular member 250 each time a batter mistakenly strikes the upper tubular member 250. The flexibility of the upper tubular member 250 permits the outlet portion thereof to be bent to any desired angle. Flexible coupling sleeve 290 serves to grip and hold the upper tubular member 250 in any desired position. A fastball spin is simulated using the apparatus of FIG. 3 which is created, for example, by placing the base of the apparatus on home plate and having exit port 270 pointed to or facing the pitcher's mound or rubber for either a right or left handed batter. The curveball spin is simulated by having the exit port 270 pointed to or facing the catcher (180 degrees in the opposite direction) for either a right or left handed batter.

SYSTEM OPERATION

A person desiring to practice hitting or stroking a sport ball 140 first chooses the particular simulating assembly for imparting a desired spin (topspin or underspin) and attaches it to the reducer member 120 and 130.

After connecting the ball suspending apparatus 10 to an electrical power source, the operator activates the apparatus 10 by engaging the power switch 110. A sport ball 140 is then placed within the stream of forced air approximately four inches from the exit port 270. The ball 140 is held in a fixed position and begins to spin with increasing speed. After approximately nine seconds, the ball 140 has reached a maximum rate of spin which is in excess of 1050 revolutions per minute.

The operator then takes a position to strike the ball 140. When the ball 140 is struck, it will react in a manner dictated by the spin thereon. In this way, the operator is allowed to study the way different spins dictate the trajectory (and spin) of the struck ball 140 in flight and when it bounces off the playing surface. This procedure is repeated for the duration of the practice session.

If the upper tubular member 250 is struck by a bat or other object, the resilient, flexible hose material 340 allows the upper tubular member 250 to either spring or be bent back into the desired configuration.

While the invention has been particularly shown and described in reference to the preferred embodiments thereof, it will be understood by those skilled in the art that changes in form and details may be made without departing from the spirit and scope of the invention.

I claim:

1. An improved ball suspending apparatus for suspending and spinning a sport ball in one position comprising:

blower means operably connected to a power source for creating a stream of forced air;

tubular means having a straight portion and a bent end portion coupled to said blower means for directing said stream of forced air onto said sport ball to both suspend and rotate said sport ball in one position at an angle different than the vertical and in general axial alignment with said end portion; and a plurality of interchangeable tubular means, each of said plurality of interchangeable tubular means having said uppermost portion held at a different angle from the remaining plurality of tubular means.

2. An improved ball suspending apparatus in accordance with claim 1 wherein said bent end portion of said tubular means is constructed of a resilient material.

3. An improved ball suspending apparatus in accordance with claim 1 further comprising housing member means for enclosing and supporting said blower means.

4. An improved ball suspending apparatus in accordance with claim 1 wherein said blower means is electrically powered by conventional household current.

5. An improved ball suspending apparatus in accordance with claim 1 further comprising switch means for turning on and off said ball suspending apparatus.

6. An improved ball suspending apparatus in accordance with claim 5 wherein said switch means varies the output level of said blower means.

7. An improved ball suspending apparatus in accordance with claim 1 wherein said housing member means is comprised of a plurality of sections.

8. An improved ball suspending apparatus in accordance with claim 1 further comprising a plurality of detachable leg means for supporting said ball suspending apparatus.

9. An improved ball suspending apparatus in accordance with claim 1 wherein said sport ball is a baseball.

10. An improved ball suspending apparatus in accordance with claim 1 wherein said sport ball is a softball.

11. An improved ball suspending apparatus in accordance with claim 1 wherein said angle different from the vertical is between about 1 to about 42 degrees from the vertical.

12. An improved ball suspending apparatus in accordance with claim 11 wherein said angle different from the vertical is a about a 35 degree angle from the vertical.

13. An improved ball suspending apparatus in accordance with claim 1 wherein said blower means is a 120 volt, 50/60 hertz, thru-flow design vacuum motor, producing 124 cubic feet per minute and 93 inches of water static pressure.

14. An improved ball suspending apparatus in accordance with claim 1 wherein said sport ball is a baseball, said tubular means rotating said baseball with a spin to simulate the spin of a fastball.

15. An improved ball suspending apparatus in accordance with claim 14 wherein said bent end portion being angled to the left with respect to a right handed person ready to swing a bat at said baseball spinning like a fastball, said person's shoulders being parallel to said bent end portion.

16. An improved ball suspending apparatus in accordance with claim 1 wherein said sport ball is a baseball, said tubular means rotating said baseball with a spin to simulate the spin of a curveball.

17. An improved ball suspending apparatus in accordance with claim 16 wherein said bent end portion being angled to the right with respect to a right handed person ready to swing a bat at said baseball spinning like a curveball, said person's shoulders being parallel to said bent end portion.

18. A method for suspending and spinning a sport ball in one position comprising the steps of:

providing blower means operably connected to a power source for creating a stream of forced air;

providing tubular means having a straight portion and a bent end portion coupled to said blower means for directing said stream of forced air onto said sport ball to both suspend and rotate said sport ball in one position at an angle different than vertical and in general axial alignment with said end portion; and thereafter placing a sport ball in said stream of forced air; and providing a plurality of interchangeable tubular means, each of said plurality of interchangeable tubular means having said uppermost portion held at a different angle from the remaining plurality of tubular means.

19. A method for suspending and spinning a sport ball in one position in accordance with claim 10 further comprising the step of constructing said bent end of said tubular means of a resilient material.

20. A method for suspending and spinning a sport ball in one position in accordance with claim 18 further comprising the step of providing housing member means for enclosing and supporting said blower means.

21. A method for suspending and spinning a sport ball in one position in accordance with claim 18 further comprising the step of electrically powering said blower means by conventional household current.

22. A method for suspending and spinning a sport ball in one position in accordance with claim 18 further comprising the step of providing switch means for turning on and off said ball suspending apparatus.

23. A method for suspending and spinning a sport ball in one position in accordance with claim 22 further comprising the step of varying the output level of said blower means.

24. A method for suspending and spinning a sport ball in one position in accordance with claim 18 further comprising the step of assembling said housing member means from a plurality of sections.

25. A method for suspending and spinning a sport ball in one position in accordance with claim 18 further comprising the step of supporting said ball suspending apparatus at variable heights by providing a plurality of detachable leg means for supporting said ball suspending apparatus.

26. A method for suspending and spinning a sport ball in accordance with claim 18 wherein said sport ball is a baseball.

27. A method of suspending and spinning a sport ball in accordance with claim 18 wherein said sport ball is a softball.

28. A method for suspending and spinning a sport ball in accordance with claim 18 further comprising the step of angling said tubular means at an angle between about 1 to about 42 degrees from the vertical.

29. A method for suspending and spinning a sport ball in accordance with claim 28 wherein the angle of said tubular means is about a 32 degree angle from the vertical.

30. A method for suspending and spinning a sport ball in accordance with claim 18 wherein said blower means is a 120 volt, 50/60 hertz, thru-flow design vacuum motor, producing 124 cubic feet per minute and 93 inches of water static pressure.

31. A method in accordance with claim 18 wherein said sport ball is a baseball, said tubular means rotating said baseball with a spin to simulate the spin of a fastball.

32. A method in accordance with claim 31 wherein said bent end portion being angled to the left with respect to a right handed person ready to swing a bat at said baseball spinning like a fastball, said person's shoulders being parallel to said bent end portion.

33. A method in accordance with claim 18 wherein said sport ball is a baseball, said tubular means rotating said baseball with a spin to simulate the spin of a curveball.

34. A method in accordance with claim 33 wherein said bent end portion being angled to the right with respect to a right handed person ready to swing a bat at said baseball spinning like a curveball, said person's shoulders being parallel to said bent end portion.

* * * * *

UNITED STATES PATENT AND TRADEMARK OFFICE

CERTIFICATE OF CORRECTION

PATENT NO. : 4,858,921

DATED : August 22, 1989

INVENTOR(S) : Harold L. Eustice, et al

It is certified that error appears in the above-identified patent and that said Letters Patent is hereby corrected as shown below:

Claim 29, line 3 change

"32" to - --35--

Item [63] "1984" should be --1987--

Signed and Sealed this

Twenty-ninth Day of January, 1991

*Attest:*

HARRY F. MANBECK, JR.

*Attesting Officer*

*Commissioner of Patents and Trademarks*